US009030366B2

(12) United States Patent
Ito et al.

(10) Patent No.: US 9,030,366 B2
(45) Date of Patent: May 12, 2015

(54) RADIO APPARATUS AND ANTENNA DEVICE INCLUDING MAGNETIC MATERIAL FOR ISOLATION

(75) Inventors: Naoto Ito, Tokyo (JP); Akihiro Tsujimura, Tokyo (JP); Takashi Amano, Saitama-ken (JP); Naoyuki Nakagawa, Tokyo (JP); Seiichi Suenaga, Kanagawa-ken (JP); Tomoko Eguchi, Tokyo (JP); Toshiro Hiraoka, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1166 days.

(21) Appl. No.: 12/503,207

(22) Filed: Jul. 15, 2009

(65) Prior Publication Data

US 2010/0156732 A1 Jun. 24, 2010

(30) Foreign Application Priority Data

Dec. 22, 2008 (JP) ..... 2008-325865

(51) Int. Cl.

| | |
|---|---|
| ***H01Q 1/00*** | (2006.01) |
| ***H01Q 9/40*** | (2006.01) |
| ***H01Q 1/24*** | (2006.01) |
| ***H01Q 1/52*** | (2006.01) |
| ***H01Q 9/42*** | (2006.01) |
| ***H01Q 17/00*** | (2006.01) |

(52) U.S. Cl.

CPC ..... *H01Q 9/40* (2013.01); *H01Q 1/243* (2013.01); *H01Q 1/52* (2013.01); *H01Q 1/521* (2013.01); *H01Q 9/42* (2013.01); *H01Q 17/00* (2013.01)

(58) Field of Classification Search

None

See application file for complete search history.

(56) References Cited

U.S. PATENT DOCUMENTS

| | | | | |
|---|---|---|---|---|
| 2007/0273600 | A1* | 11/2007 | Tsujimura et al. | 343/787 |
| 2008/0191954 | A1* | 8/2008 | Tsujimura et al. | 343/787 |

FOREIGN PATENT DOCUMENTS

| | | | |
|---|---|---|---|
| JP | 2005-080023 | A | 3/2005 |
| JP | 2007-006465 | A | 1/2007 |
| JP | 2007-124638 | A | 5/2007 |

OTHER PUBLICATIONS

Japanese Office Action dated May 29, 2012 (and English translation thereof) in counterpart Japanese Application No. 2008-325865.

* cited by examiner

*Primary Examiner* — Graham Smith

(74) *Attorney, Agent, or Firm* — Holtz, Holtz, Goodman & Chick PC

(57) ABSTRACT

An antenna device arranged around a printed circuit board is provided. The antenna device has an antenna element connected to a feeder circuit provided on the printed board. The antenna device has an isolating material provided between the antenna element and the substrate material. The isolating material is constituted by an insulating substrate material and a plurality of pieces of magnetic material provided on the substrate material. Adjacent ones of the pieces of the magnetic material are arranged separate from each other.

15 Claims, 5 Drawing Sheets

RADIO APPARATUS AND ANTENNA DEVICE INCLUDING MAGNETIC MATERIAL FOR ISOLATION

CROSS REFERENCE TO RELATED APPLICATIONS

This application is based upon and claims the benefit of priority from the prior Japanese Patent Application No. 2008-325865 filed on Dec. 22, 2008;
the entire contents of which are incorporated herein by reference.

BACKGROUND OF THE INVENTION

1. Field of the Invention

The present invention relates to a radio apparatus and an antenna device, and in particular to an antenna device including magnetic material for isolation and a radio apparatus having the antenna device.

2. Description of the Related Art

A small-sized radio apparatus such as a mobile phone often has limited mounting space, and thus, in some cases, suffers from a problem of interference caused by electromagnetic or capacitive coupling between an antenna and each of portions of an electrical circuit of the radio apparatus. In particular, in some cases, the antenna suffers from a problem of degraded radiation efficiency caused by coupling with a conductive portion of a circuit board or a housing (called a peripheral conductive portion hereafter).

To the above problems, a solution by means of magnetic material for isolating an antenna from a peripheral conductive portion has been studied. As an antenna adopting such a solution, an antenna module adapted for a card of a radio frequency identification (RFID) system is disclosed in Japanese Patent Publication of Unexamined Applications (Kokai), No. 2005-80023.

The antenna module of JP 2005-80023 is constituted by an antenna board provided with an antenna coil, a magnetic core material and an interference shielding plate layered on top of each other. The magnetic core material of the above antenna module shows different magnetic characteristics between on a face on a side of the antenna coil and on a face on a side of the interference shielding plate, so as to cope with both a communication characteristic of the antenna coil and an interference shielding effect.

Furthermore, a technology for interposing a sheet member including magnetic material between an antenna element and a conductive material so as to increase radiation efficiency is disclosed, e.g., in Japanese Patent Publication of Unexamined Applications (Kokai), No. 2007-124638. The sheet member of JP 2007-124638 is formed by an interference shielding layer formed by the magnetic material, a conductive layer and an adhesive layer, and is arranged to prevent antenna impedance from decreasing by selecting a magnetic permeability value of the interference shielding layer, and so on.

According to JP 2005-80023 described above, a filling ratio of soft magnetic powder is relatively lowered and the insulation characteristic is enhanced on the face of the magnetic core material on the side of the antenna coil, so that an eddy current is prevented from occurring and the loss of the antenna coil is reduced. The filling ratio of the soft magnetic powder is relatively raised on the face of the magnetic core material on the side of the interference shielding plate so that electromagnetic isolation is reinforced between the antenna board and the interference shielding plate.

If an antenna and a peripheral conductive portion are electro-magnetically isolated by means of magnetic material, it is important to reduce an eddy current and to reinforce electromagnetic isolation in parallel. The antenna module of JP 2005-80023 has the magnetic core material formed by a plurality of layers of different filling ratios of the soft magnetic powder so as to meet both the above requirements. The antenna module of JP 2005-80023 has a problem, however, in that it requires a manufacturing process for selecting a plurality of kinds of material of different characteristics and layering them on top of each other.

The technology disclosed in JP 2007-124638 uses a method such as selecting a mixing ratio of a plurality of kinds of soft magnetic powder. The configuration of JP 2007-124638 has a problem in that it requires a manufacturing process for selecting such material and layering them similarly as the configuration of JP 2005-80023.

SUMMARY OF THE INVENTION

Accordingly, an object of the present invention is to electro-magnetically isolate an antenna from a peripheral conductive portion by using simply formed magnetic material so as to reduce an eddy current and to reinforce electromagnetic isolation in parallel.

To achieve the above object, according to one aspect of the present invention, an antenna device arranged around a printed circuit board is provided. The antenna device has an antenna element connected to a feeder circuit provided on the printed board. The antenna device has an isolating material provided between the antenna element and the substrate material. The isolating material is constituted by an insulating substrate material and a plurality of pieces of magnetic material provided on the substrate material. Adjacent ones of the pieces of the magnetic material are arranged separate from each other.

DETAILED DESCRIPTION OF THE INVENTION

Figure 1:
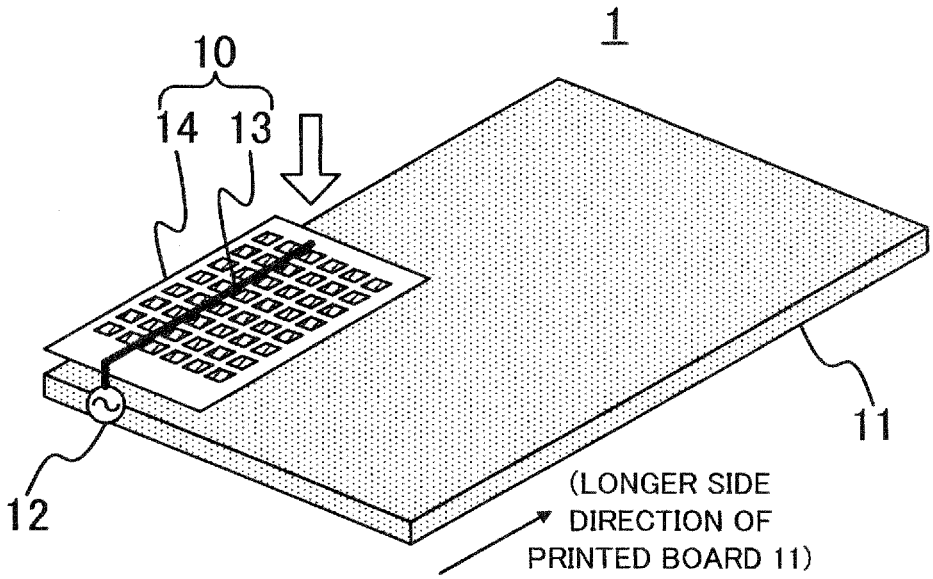
FIG. 1 is a perspective view showing a configuration of a main portion of a radio apparatus including an antenna device both of a first embodiment of the present invention.

Hereinafter, embodiments of the present invention will be described in detail. In following descriptions, terms such as upper, lower, left, right, horizontal or vertical used while referring to a drawing shall be interpreted on a page of the drawing unless otherwise noted. Moreover, a same reference numeral given in no less than two drawings shall represent a same member or a same portion.

A first embodiment of the present invention will be described with reference to FIGS. 1-9. FIG. 1 is a perspective view showing a configuration of a main portion of a radio apparatus 1 including an antenna device 10 both of the first embodiment. The radio apparatus 1 has a printed circuit board (simply called a printed board hereafter) 11 provided with a feeding portion 12, an antenna element 13 connected to the feeding portion 12 and an isolating material 14. Among these portions, the antenna element 13 and the isolating material 14 constitutes the antenna device 10. The isolating material 14 is provided between the printed board 11 and the antenna element 13.

Figure 2:
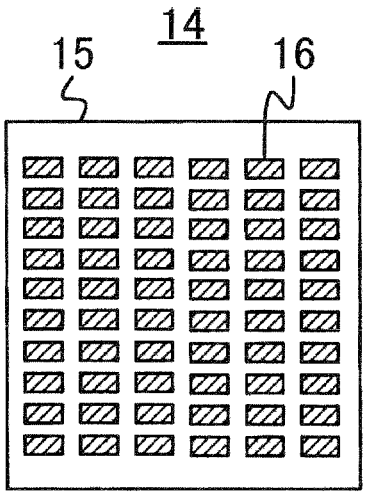
FIG. 2 is a plan view showing a configuration of an isolating material of the first embodiment.

FIG. 2 is a plan view showing a configuration of the isolating material 14 as viewed in a direction indicated by a block arrow shown in FIG. 1. The isolating material 14 is constituted by an insulating substrate material 15 and a plurality of pieces of magnetic material (magnetic pieces) 16 provided on the insulating substrate material 15. Adjacent ones of the magnetic pieces 16 are arranged separate from each other. In FIG. 2, the top-to-bottom direction corresponds to a longer side direction of the printed board 11 shown in FIG. 1.

The isolating material 14 provided with the plural magnetic pieces 16 has an effect to isolate, from the printed board 11, a magnetic field that the antenna element 13 generates around itself upon being excited. Thus, the isolating material 14 can suppress cancellation between electromagnetic fields excited by currents distributed on the antenna element 13 and on a ground circuit of the printed board 11 in opposite directions to each other, upon the antenna element 13 being excited, so as to contribute to increasing radiation efficiency of the antenna device 10.

As actually having a non-zero value of conductivity, however, magnetic material causes eddy current loss similarly as metal placed in a variable magnetic field does. As a value of the eddy current loss depends upon a length of a magnetic path formed in the magnetic material, the magnetic material can be divided into a plurality of pieces and adjacent ones of the pieces can be separate from each other so that the magnetic path is divided into parts and the eddy current loss can be reduced. It is preferable for reducing the eddy current loss that the length of each of the magnetic pieces 16 be small.

The magnetic pieces 16 also have a characteristic of dielectric material based on its relative permittivity value. As the length of each of the magnetic pieces 16 is smaller, a value of dielectric polarization that occurs on each of the magnetic pieces 16 is smaller, and thus so are values of equivalent relative permittivity and dielectric loss of the magnetic pieces 16 as a whole. Furthermore, as the separation between adjacent ones of the magnetic pieces 16 is greater, their polarized electric charges are less coupled so that the dielectric loss can be more reduced.

As described above, it is desirable, from a viewpoint of reducing the eddy current loss and the dielectric loss, to make each of the magnetic pieces 16 as small as possible and to arrange adjacent ones of them as separate as possible from each other. As the magnetic pieces 16 are made and arranged as described above to a greater extent, however, a surface area or a volume of the magnetic material of the isolating material 14 as a whole is reduced more, so that its characteristic as the magnetic material is lost more and so is an isolation effect between the antenna element 13 and the printed board 11. In the end, the size of each of the magnetic pieces 16 and the separation between adjacent ones of the magnetic pieces 16 have to be traded off against each other so as to be properly set.

Although being assumed to be formed by dielectric material, the insulating substrate material 15 may be formed by insulating magnetic material such as ferrite. In such a case, the isolating material 14 can raise permeability as a whole so as to enhance the isolation effect.

Figure 3:
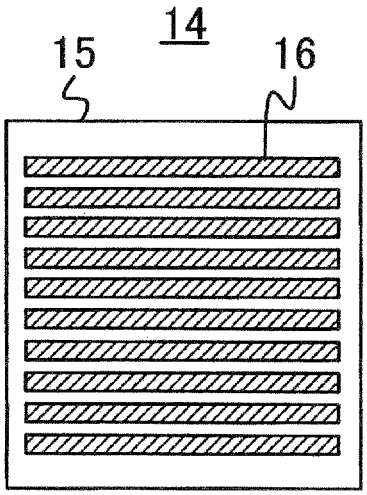
FIG. 3 is a plan view showing a configuration of a first modification of the isolating material of the first embodiment.

FIG. 3 is a plan view showing a configuration of a first modification of the isolating material 14 (modified with respect to a plane shape or arrangement of the magnetic piece 16, throughout the description of the first embodiment hereafter) as viewed from the same direction as in FIG. 2. Reference numerals shown in FIG. 3 are same as shown in FIGS. 1 and 2 for convenience. Each of the magnetic pieces 16 of the modification shown in FIG. 3 is shaped long in a left-to-right direction (long sideways). Shaping the magnetic pieces 16 in this way can contribute to balance between the isolation effect and the loss reduction of the isolating material 14 in some cases.

Figure 4:
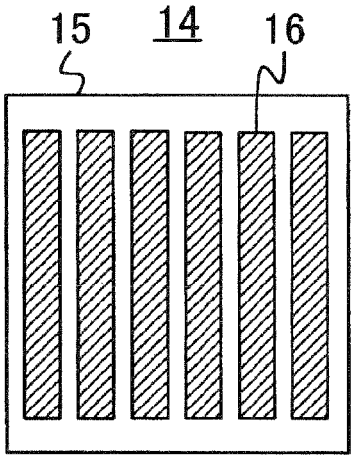
FIG. 4 is a plan view showing a configuration of a second modification of the isolating material of the first embodiment.

FIG. 4 is a plan view showing a configuration of a second modification as viewed from the same direction as in FIG. 2. Reference numerals shown in FIG. 4 are same as shown in FIGS. 1 and 2 for convenience. Each of the magnetic pieces 16 of the modification shown in FIG. 4 is shaped long in a top-to-bottom direction (longer than is wide). Shaping the magnetic pieces 16 in this way can contribute to balance between the isolation effect and the loss reduction of the isolating material 14 in some cases.

Figure 5:
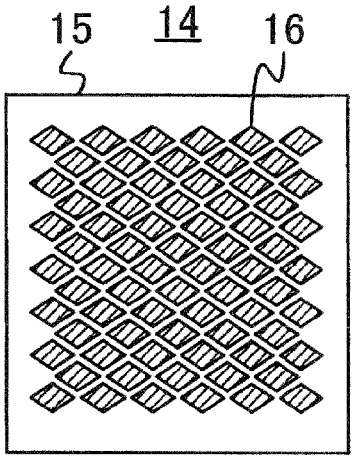
FIG. 5 is a plan view showing a configuration of a third modification of the isolating material of the first embodiment.

FIG. 5 is a plan view showing a configuration of a third modification as viewed from the same direction as in FIG. 2. Reference numerals shown in FIG. 5 are same as shown in FIGS. 1 and 2 for convenience. Each of the magnetic pieces 16 of the modification shown in FIG. 5 is diamond-shaped. Shaping the magnetic pieces 16 in this way can contribute to balance between the isolation effect and the loss reduction of the isolating material 14 in some cases.

Figure 6:
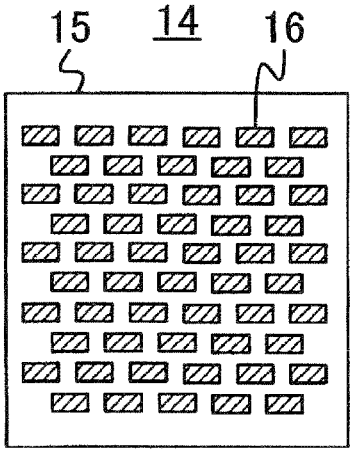
FIG. 6 is a plan view showing a configuration of a fourth modification of the isolating material of the first embodiment.

FIG. 6 is a plan view showing a configuration of a fourth modification as viewed from the same direction as in FIG. 2. Reference numerals shown in FIG. 6 are same as shown in FIGS. 1 and 2 for convenience. Each of the magnetic pieces 16 of the modification shown in FIG. 6 is shaped as shown in FIG. 2, and arrangements of the magnetic pieces 16 alternate between adjacent two rows. Shaping and arranging the magnetic pieces 16 in this way can contribute to balance between the isolation effect and the loss reduction of the isolating material 14 in some cases.

Figure 7:
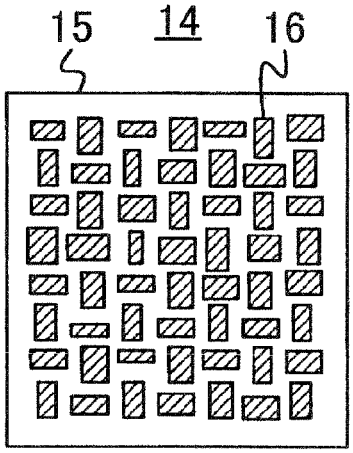
FIG. 7 is a plan view showing a configuration of a fifth modification of the isolating material of the first embodiment.

FIG. 7 is a plan view showing a configuration of a fifth modification as viewed from the same direction as in FIG. 2. Reference numerals shown in FIG. 7 are same as shown in FIGS. 1 and 2 for convenience. The magnetic pieces 16 of the modification shown in FIG. 7 are of different sizes and arranged at uneven positions in the horizontal and vertical directions. Shaping and arranging the magnetic pieces 16 in this way can contribute to balance between the isolation effect and the loss reduction of the isolating material 14 in some cases.

Figure 8:
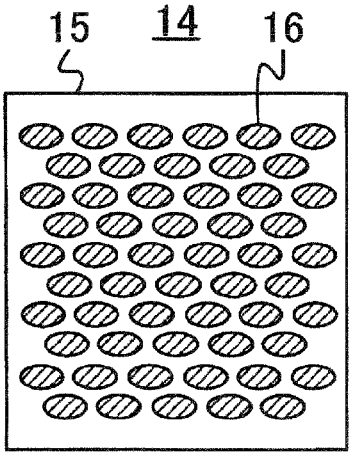
FIG. 8 is a plan view showing a configuration of a sixth modification of the isolating material of the first embodiment.

FIG. 8 is a plan view showing a configuration of a sixth modification as viewed from the same direction as in FIG. 2. Reference numerals shown in FIG. 8 are same as shown in FIGS. 1 and 2 for convenience. Each of the magnetic pieces 16 of the modification shown in FIG. 8 is shaped elliptical. Shaping the magnetic pieces 16 in this way can contribute to balance between the isolation effect and the loss reduction of the isolating material 14 in some cases.

Figure 9:
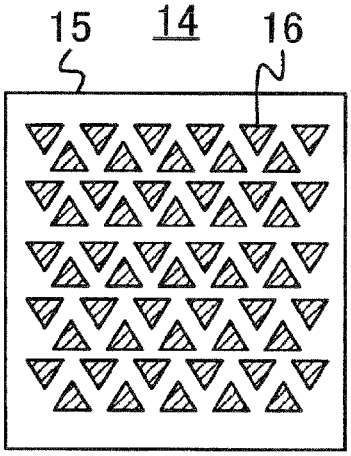
FIG. 9 is a plan view showing a configuration of a seventh modification of the isolating material of the first embodiment.

FIG. 9 is a plan view showing a configuration of a seventh modification as viewed from the same direction as in FIG. 2. Reference numerals shown in FIG. 9 are same as shown in FIGS. 1 and 2 for convenience. Each of the magnetic pieces 16 of the modification shown in FIG. 9 is shaped triangular. Shaping the magnetic pieces 16 in this way can contribute to balance between the isolation effect and the loss reduction of the isolating material 14 in some cases.

Shapes of each of the magnetic pieces 16 and relative positions between adjacent ones of the magnetic pieces 16 can be variously modified apart from the modifications described above. Furthermore, a plurality of the modifications can be combined so as to form another modification. Shaping the magnetic pieces 16 in this way can contribute to balance between the isolation effect and the loss reduction of the isolating material 14 in some cases.

The magnetic piece 16 may be formed by anisotropic magnetic material. Anisotropic magnetic material shows a relatively high permeability value in a specific direction in a two- or three-dimensional coordinate system, and almost shows a permeability value of free space in other directions. The permeability value in the above specific direction (called a hard magnetization axis) can be, even as an absolute value, higher than a permeability value of ordinary isotropic magnetic material.

Each of the magnetic pieces 16 can be arranged in such a way that the hard magnetization axis described above is perpendicular to a main direction of the antenna element 13 (that corresponds to, upon the antenna element 13 being fed, a main direction of a current distributed on the antenna element 13, and coincides with the longer side direction of the printed board 11 in FIG. 1). The antenna device 10 can thereby have a high permeability value in a direction of a magnetic field generated around the antenna element 13, so as to enhance the isolation effect of the isolating material 14.

According to the first embodiment of the present invention described above, the antenna device having, between the antenna element and the printed board, the isolating material provided with the plural magnetic pieces arranged separate from each other can keep balance between the isolation effect and the loss so as to enhance radiation efficiency.

Figure 10:
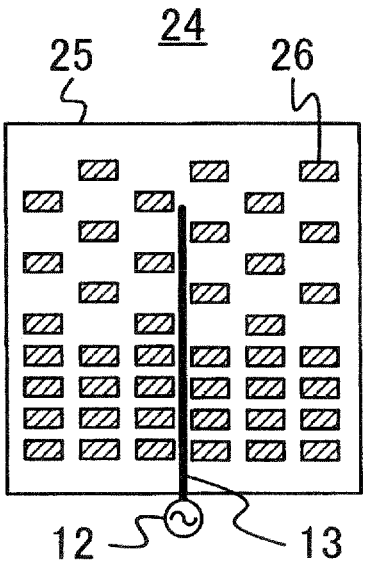
FIG. 10 is a plan view showing a configuration of an isolating material of an antenna device of a second embodiment of the present invention.

A second embodiment of the present invention will be described with reference to FIG. 10. The antenna device 10 and the radio apparatus 1 of the first embodiment are modified to form an antenna device and a radio apparatus of the second embodiment in such a way that a two-dimensional distribution of the magnetic pieces 16 of the isolating material 14 is modified. FIG. 10 is a plan view showing a configuration of an isolating material 24 modified from the isolating material 14, as viewed from the same direction as in FIG. 2 of the first embodiment. FIG. 10 also shows the feeding portion 12 and the antenna element 13 which are the same as shown in FIG. 2.

The isolating material 24 is constituted by an insulating substrate material 25 and a plurality of pieces of magnetic pieces 26 provided on the insulating substrate material 25. The magnetic pieces 26 are relatively densely provided around the feed portion 12 on the substrate material 25, and relatively sparsely provided around the open end of the antenna element 13.

If the antenna element 13 is fed, a current of a relatively high amplitude is distributed around the feeding portion 12, and a current of a relatively low amplitude is distributed around an open end of the antenna element 13. Thus, the magnetic field generated around the antenna element 13 has a relatively high amplitude and a relatively low amplitude around the feeding portion 12 and the open end, respectively. Hence, in order to make sure of the isolation effect between a printed board that is not shown and is placed below the isolating material 24 (corresponding to the back of the page) and the antenna element 13, it is effective to more densely arrange the magnetic pieces 26 around the feeding portion 12.

The shape and arrangement of each of the magnetic pieces 26 shown in FIG. 10 are exemplary only, and, e.g., the shapes, the arrangements and density of the magnetic pieces 26 shown in FIGS. 2-9 of the first embodiment can be combined with the second embodiment.

According to the second embodiment of the present invention described above, the magnetic pieces are arranged densely or sparsely in accordance with the amplitude of the current distributed on the antenna element so that the isolation effect can be maintained regardless of the decrease of the magnetic pieces.

Figure 11:
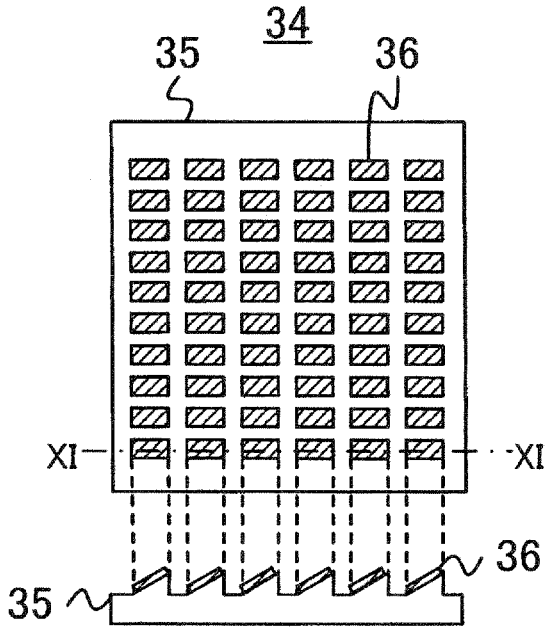
FIG. 11 is a plan view showing a configuration of an isolating material (a first modification of the isolating material of the first embodiment modified in the direction of the thickness) of an antenna device of a third embodiment of the present invention.

A third embodiment of the present invention will be described with reference to FIGS. 11-16. The antenna device 10 and the radio apparatus 1 of the first embodiment are modified to form an antenna device and a radio apparatus of the third embodiment in such a way that the isolating material 14 is modified in a direction of its thickness, or to be formed by a plurality of layers overlaid on top of each other. FIG. 11 shows a configuration of an isolating material 34, i.e., a first example modified in the direction of the thickness as described above.

An upper part of FIG. 11 is a plan view of the isolating material 34 as viewed in the same direction as in FIG. 2. A lower part of FIG. 11 is a cross-sectional view of the isolating material 34 on the line "XI-XI" shown in the plan view. The isolating material 34 is constituted by an insulating substrate material 35 and a plurality of magnetic pieces 36 provided on the insulating substrate material 35. The substrate material 35 has an unevenly shaped surface.

Each of the magnetic pieces 36 is provided on the unevenly shaped (sawtooth-shaped) surface of the substrate material 35 separately from each other. Each of the magnetic pieces 36 is formed on the surface of the substrate material 35 separately from each other by using, e.g. a sputtering method.

In some cases, it can be difficult in a manufacturing process to divide a magnetic sheet into pieces so as to form each of the magnetic pieces. If the unevenness of the surface of the substrate material is used, each of the magnetic pieces can be formed separately from each other of itself as a magnetic membrane is formed. The manufacturing process can thereby be made less difficult. Furthermore, the isolating material 34 need not decrease a surface area or a volume of the magnetic material as a whole, and can thereby maintain characteristics of the magnetic material.

Figure 12:
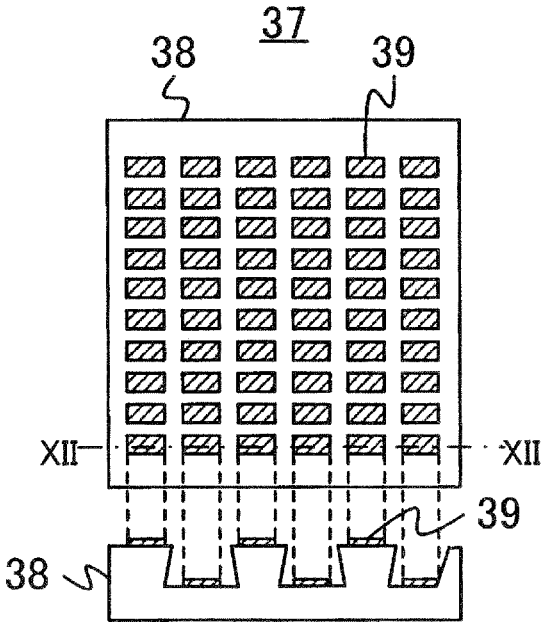
FIG. 12 is a plan view showing a configuration of another isolating material (a second modification of the isolating material of the first embodiment modified in a direction of a thickness) of the antenna device of the third embodiment.

FIG. 12 shows a configuration of an isolating material 37, i.e., a second example modified in the direction of the thickness. An upper part of FIG. 12 is a plan view of the isolating material 37 as viewed in the same direction as in FIG. 2. A lower part of FIG. 12 is a cross-sectional view on the line "XII-XII" shown in the plan view. The isolating material 37 is constituted by an insulating substrate material 38 and a plurality of magnetic pieces 39 provided on the insulating substrate material 38. The substrate material 38 has an unevenly shaped surface.

Each of the plural magnetic pieces 39 is provided on either a convex portion or a concave portion of the surface of the substrate material 38. Each of the magnetic pieces 39 is formed on either a convex portion or a concave portion of the surface of the substrate material 38 by using, e.g., a sputtering method. The uneven shape of the surface of the substrate material 35 or 38 shown in FIG. 11 or 12 is exemplary only, and may be variously modified.

Figure 13:
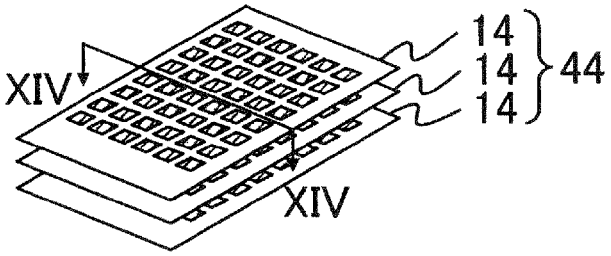
FIG. 13 is a perspective view showing a configuration of an isolating material of a multilayer isolating material of the antenna device of the third embodiment.
Figure 14:
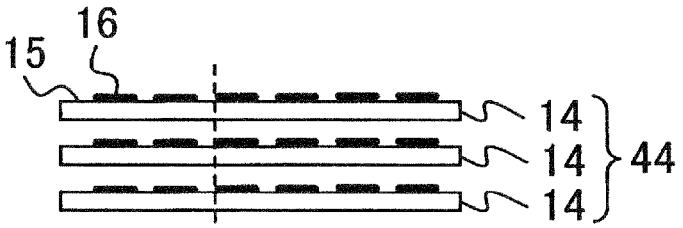
FIG. 14 is a cross-sectional view of the multilayer isolating material of the third embodiment.

FIG. 13 is a perspective view showing a configuration of a multilayer isolating material 44 formed by layering a plurality of the isolating material 14 of the first embodiment in the direction of the thickness. FIG. 14 is a cross-sectional view on the line "XIV-XIV" indicated by an arrow in FIG. 13.

The isolating material 14 shown in FIG. 13 or 14 is configured as shown in FIG. 2. The isolating material 14 is not limited to the above, and may be configured as shown in one of FIG. 3-12 or in another way. The number of the layers is not limited to three. Such a multilayer configuration can contribute to increasing a volume of magnetic material included in the whole multilayer isolating material 44, raising permeability and enhancing the isolation effect.

FIG. 14 shows a vertical dotted line indicating that the magnetic pieces 14 are arranged at the same positions as viewed in the direction of the thickness. Such an arrangement at the same positions has an effect that a coupling of dielectric polarizations generated on each of the magnetic pieces 16 is alleviated so as to reduce the permittivity and the dielectric loss of the multilayer isolating material 44 as a whole.

Figure 15:
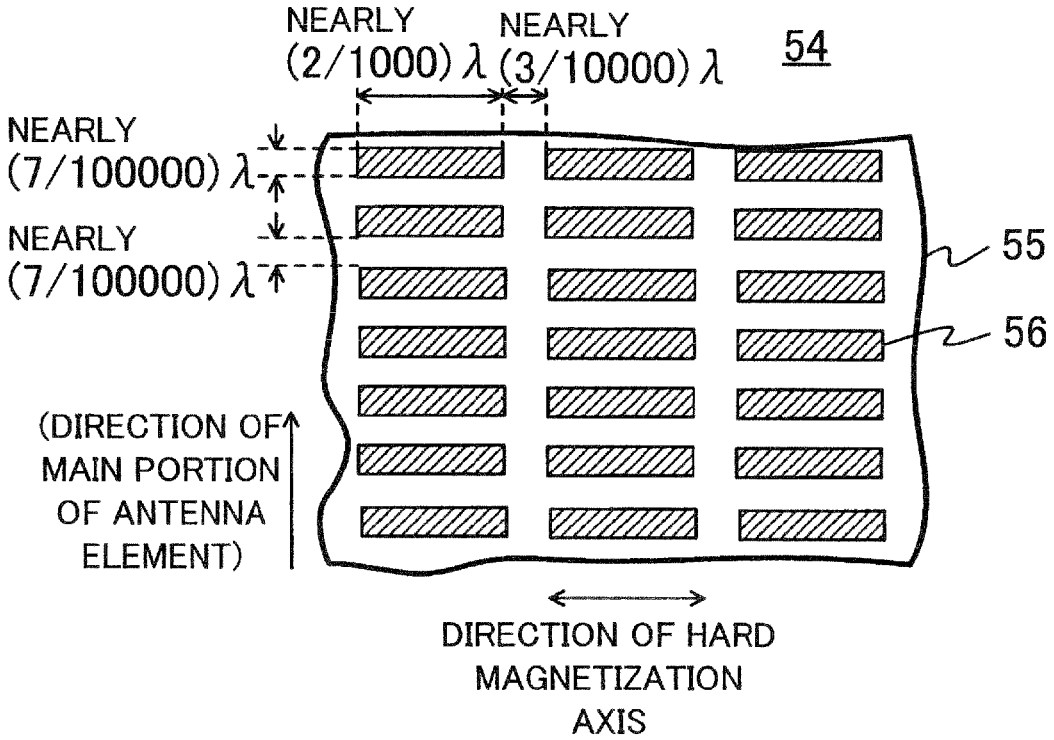
FIG. 15 is a plan view showing a configuration of an isolating material of the third embodiment to be estimated by a simulation and a size of each of portions of the isolating material.

Radiation efficiency of an example of the multilayer isolating material that has been estimated by simulation will be explained with reference to FIGS. 15 and 16. FIG. 15 is a plan view partially showing a configuration and a size of each of portions of a single-layered isolating material 54 forming the multilayer isolating material as viewed from the same direction as in FIG. 2 of the first embodiment. It is assumed that an antenna element and a printed board which are not shown are isolated by the multilayer isolating material, and that a main portion of the antenna element is arranged in a top-to-bottom direction in FIG. 15 (similarly as shown in FIG. 1 or FIG. 10).

The isolating material 54 is constituted by an insulating substrate material 55 and a plurality of magnetic pieces 56 provided on the substrate material 55. The substrate material 55 is formed by a dielectric material having a relative permittivity value (real part) of two and being as thick as nearly (4/100000)λ. The magnetic piece 56 is formed by anisotropic magnetic material, and its hard magnetization axis is directed in a horizontal direction shown in FIG. 15. The magnetic piece 56 has relative permeability values (real part) of 100 and one in the direction of the hard magnetization axis and in the direction perpendicular thereto, respectively. The magnetic piece 56 has an electrical conductivity value of $1*10^4$ $S \cdot m^{-1}$.

Each of the magnetic pieces 56 is nearly (2/1000)λ long and nearly (7/100000)λ wide. Adjacent ones of the magnetic pieces 56 are separate from each other by nearly (3/10000)λ and (7/100000)λ in the horizontal and vertical directions, respectively. A plurality of the isolating materials 54 each of which is configured as described above are layered on top of each other to be as thick as nearly (3/1000)λ so as to form the multilayer isolating material described above.

Assume that the multilayer isolating material described above is provided between an open ended and inverse L-shaped monopole antenna element (having a resonant frequency of f0 hertz (Hz)) and a printed board, and that a main portion of the antenna element is arranged almost parallel to the printed board. Circular plots shown in FIG. 16 represent an example of radiation efficiency in the above configuration estimated by a simulation. FIG. 16 has horizontal and vertical axes representing the frequency (normalized by f0) and the radiation efficiency, respectively.

Figure 16:
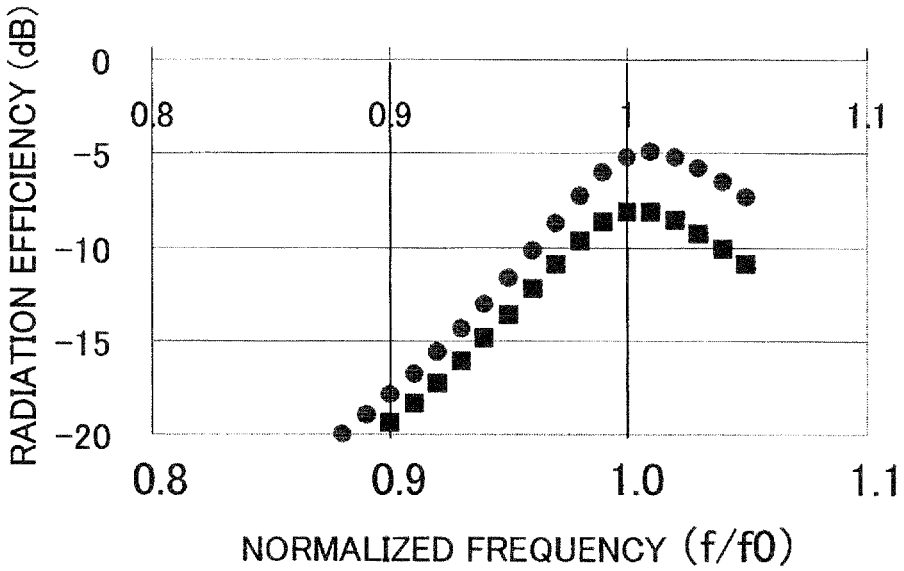
FIG. 16 shows radiation efficiency estimated by the simulation in a configuration of the third embodiment in which a plurality of the isolating materials shown in FIG. 15 is layered between an antenna element and a printed board.

Square plots shown in FIG. 16 represent radiation efficiency estimated for comparison by the same simulation in a case where no multilayer isolating material is provided between the antenna element described above and the printed board. As shown in FIG. 6, a difference of the radiation efficiency between the circular plot and the square plot at f0 Hz, i.e., the resonant frequency of the antenna element, shows that the radiation efficiency increases by 4 decibel (dB) after the multilayer isolating material is provided. Such an increase of the radiation efficiency obviously shows an effect of the present invention.

According to the third embodiment of the present invention described above, the isolating material can be modified in a direction of its thickness or to be formed by a plurality of layers so that a difficulty in manufacturing the isolating material can be reduced, or the isolation effect can be enhanced.

In the above description of the embodiments, the types, shapes, configurations and connections of the antenna elements, the shapes, arrangements and combinations of the isolating materials and so on are considered as exemplary only, and thus may be variously modified within the scope of the present invention.

The particular hardware or software implementation of the present invention may be varied while still remaining within the scope of the present invention. It is therefore to be understood that within the scope of the appended claims and their equivalents, the invention may be practiced otherwise than as specifically described herein

What is claimed is:

1. An antenna device comprising:

an antenna element connected to a feeder circuit provided on a printed circuit board; and an isolating member provided between the antenna element and the printed circuit board, wherein the isolating member comprises: (i) a substrate which has a first surface and a second surface that is opposite to the first surface, which is formed by one of a dielectric material and an insulating magnetic material, and which is arranged on the printed circuit board, wherein the first surface of the substrate faces the antenna element, and (ii) a plurality of magnetic pieces two-dimensionally provided on the first surface of the substrate, wherein the second surface of the substrate faces the printed circuit board, wherein adjacent ones of the plurality of magnetic pieces are arranged to be separate from each other, wherein the plurality of magnetic pieces are formed by an anisotropic magnetic material, wherein the plurality of magnetic pieces are arranged such that a hard magnetization axis of the anisotropic magnetic material is substantially perpendicular to a main direction of the antenna element, and wherein the first surface of the substrate is sawtooth-shaped and each of the plurality of magnetic pieces is provided on the first surface of the substrate separately from each other.

2. The antenna device of claim 1, wherein the plurality of magnetic pieces are relatively densely provided around a portion of the antenna element where a current of a relatively high amplitude is distributed upon the antenna element being fed, and are relatively sparsely provided around a portion of the antenna element where a current of a relatively low amplitude is distributed upon the antenna element being fed.

3. The antenna device of claim 1, wherein the plurality of magnetic pieces are provided on convex portions and concave portions formed on the first surface of the substrate.

4. The antenna device of claim 1, wherein the isolating member comprises a plurality of isolating members which are provided between the antenna element and the printed circuit board.

5. A radio apparatus, comprising:

a printed circuit board;

an antenna element provided around the printed circuit board, the antenna element being connected to a feeding point provided on the printed circuit board; and an isolating member provided between the antenna element and the printed circuit board, wherein the isolating member comprises: (i) a substrate which has a first surface and a second surface that is opposite to the first surface, which is formed by one of a dielectric material and an insulating magnetic material, and which is arranged on the printed circuit board, wherein the first surface of the substrate faces the antenna element, and (ii) a plurality of magnetic pieces two-dimensionally provided on the first surface of the substrate, wherein the second surface of the substrate faces the printed circuit board, wherein adjacent ones of the plurality of magnetic pieces are arranged to be separate from each other, wherein the plurality of magnetic pieces are formed by an anisotropic magnetic material, wherein the plurality of magnetic pieces are arranged such that a hard magnetization axis of the anisotropic magnetic material is perpendicular to a main direction of the antenna element, and wherein the first surface of the substrate is sawtooth-shaped and each of the plurality of magnetic pieces is provided on the first surface of the substrate separately from each other.

6. The radio apparatus of claim 5, wherein the plurality of magnetic pieces are relatively densely provided around a portion of the antenna element where a current of a relatively high amplitude is distributed upon the antenna element being fed, and are relatively sparsely provided around a portion of the antenna element where a current of a relatively low amplitude is distributed upon the antenna element being fed.

7. The radio apparatus of claim 5, wherein the plurality of magnetic pieces are provided on convex portions and concave portions formed on the first surface of the substrate.

8. The radio apparatus of claim 5, wherein the isolating member comprises a plurality of isolating members which are provided between the antenna element and the printed circuit board.

9. The antenna device of claim 1, wherein the substrate of the isolating member is integrally formed as a single layer having the first surface and the second surface that is opposite to the first surface.

10. The radio apparatus of claim 5, wherein the substrate of the isolating member is integrally formed as a single layer having the first surface and the second surface that is opposite to the first surface.

11. An antenna device comprising:

an antenna element connected to a feeder circuit provided on a printed circuit board; and an isolating member provided between the antenna element and the printed circuit board, wherein the isolating member comprises: (i) a substrate which has a first surface and a second surface that is opposite to the first surface, which is formed by one of a dielectric material and an insulating magnetic material, and which is arranged on the printed circuit board, wherein the first surface of the substrate faces the antenna element, and (ii) a plurality of magnetic pieces two-dimensionally provided on the first surface of the substrate, wherein the second surface of the substrate faces the printed circuit board, wherein adjacent ones of the plurality of magnetic pieces are arranged to be separate from each other, wherein the plurality of magnetic pieces are formed by an anisotropic magnetic material, wherein the plurality of magnetic pieces are arranged such that a hard magnetization axis of the anisotropic magnetic material is substantially perpendicular to a main direction of the antenna element, and wherein the plurality of magnetic pieces are provided on convex portions and concave portions formed on the first surface of the substrate.

12. The antenna device of claim 11, wherein the plurality of magnetic pieces are relatively densely provided around a portion of the antenna element where a current of a relatively high amplitude is distributed upon the antenna element being fed, and are relatively sparsely provided around a portion of the antenna element where a current of a relatively low amplitude is distributed upon the antenna element being fed.

13. The antenna device of claim 11, wherein the first surface of the substrate is sawtooth-shaped and each of the plurality of magnetic pieces is provided on the first surface of the substrate separately from each other.

14. The antenna device of claim 11, wherein the isolating member comprises a plurality of isolating members which are provided between the antenna element and the printed circuit board.

15. The antenna device of claim 11, wherein the substrate of the isolating member is integrally formed as a single layer having the first surface and the second surface that is opposite to the first surface.

* * * * *